US005348027A

United States Patent [19]

Barnes et al.

[11] Patent Number: 5,348,027

[45] Date of Patent: Sep. 20, 1994

[54] CIGARETTE WITH IMPROVED SUBSTRATE

[75] Inventors: Russell D. Barnes, Belews Creek; Chandra K. Banerjee, Pfafftown; Evon L. Crooks, Winston-Salem, all of N.C.; Jack F. Clearman, Blakely, Ga.

[73] Assignee: R. J. Reynolds Tobacco Company, Winston-Salem, N.C.

[21] Appl. No.: 882,209

[22] Filed: May 13, 1992

Related U.S. Application Data

[63] Continuation-in-part of Ser. No. 655,706, Feb. 14, 1991, Pat. No. 5,203,355.

[51] Int. Cl.[5] ..... A24B 15/00; A24D 3/06

[52] U.S. Cl. ..... 131/194; 131/331; 493/39

[58] Field of Search ..... 131/194, 331, 332, 335; 493/39, 49

[56] References Cited

U.S. PATENT DOCUMENTS

| | | | |
|---|---|---|---|
| 3,106,210 | 10/1963 | Reynolds et al. | 131/17 |
| 3,931,824 | 1/1976 | Maino et al. | 131/2 |
| 4,708,151 | 11/1987 | Shelar | 131/359 |
| 4,714,082 | 12/1987 | Banerjee et al. | 131/359 |
| 4,732,168 | 3/1988 | Resce et al. | 131/359 |
| 4,756,318 | 7/1988 | Clearman et al. | 131/359 |
| 4,782,644 | 11/1988 | Haarer et al. | 53/282 |
| 4,793,365 | 12/1988 | Sensabaugh, Jr. et al. | 131/194 |
| 4,802,568 | 2/1989 | Haarer et al. | 196/388 |
| 4,807,809 | 2/1989 | Pryor et al. | 131/84.1 |
| 4,827,950 | 5/1989 | Banerjee et al. | 131/335 |
| 4,854,331 | 8/1989 | Banerjee et al. | 131/194 |
| 4,858,630 | 8/1989 | Banerjee et al. | 131/364 |

(List continued on next page.)

FOREIGN PATENT DOCUMENTS

| | | | |
|---|---|---|---|
| 0236992A2 | 9/1987 | European Pat. Off. | A24B 15/16 |
| 0339690A2 | 11/1989 | European Pat. Off. | A24D 1/18 |
| 0342538A2 | 11/1989 | European Pat. Off. | A24F 47/00 |
| 0407792A2 | 1/1991 | European Pat. Off. | A24F 47/00 |
| 745245 | 2/1956 | United Kingdom | 131/331 |

OTHER PUBLICATIONS

Chemical and Biological Studies of New Cigarette Prototypes That Heat Instead of Burn Tobacco, R. J. Reynolds Tobacco Co. 1988 ("RJR Monograph").

Tobacco Substitutes, Noyes Data Corp. (1976) pp. 48-52-RJR Monograph, Supra.

07/569,325-Filed Aug. 1990.

07/642,233-Filed Jan. 23, 1991.

07/713,939-Filed Jun. 12, 1991.

07/722,993-Filed Jun. 28, 1991.

07/723,350-Filed Jun. 28, 1991.

07/354,605-Filed May 22, 1989.

07/414,835-Filed Nov. 29, 1989.

07/567,520-Filed Aug. 15, 1990.

07/574,327-Filed Aug. 28, 1990.

07/606,287-Filed Nov. 6, 1990.

07/621,499-Filed Dec. 7, 1990.

07/710,273-Filed Jun. 9, 1991.

*Primary Examiner*—Jennifer Bahr

*Attorney, Agent, or Firm*—Grover M. Myers; David G. Conlin

[57] ABSTRACT

A new substrate for cigarettes includes an overwrapped rod of gathered cellulose-based paper having an outer diameter of from about 4 mm to about 8 mm; wherein the paper has a basis weight in the range of about 10 $g/m^2$ to about 90 $g/m^2$; and the paper can include up to about 50 weight percent of one or more burn retardant hydrated salts. The substrate typically comprises an overwrapped rod of a gathered web of a nonwoven cellulosic material, having a length of about 10 mm; wherein the dry unit weight of the substrate rod is from about 20 mg to about 120 mg; and wherein the web of cellulosic material is embossed or scored prior to gathering, thereby providing a substrate rod with a pressure drop of from about 2 to about 40 mm of $H_2O$, under FTC conditions. When employed in a cigarette at a 10 mm length, the substrate is typically capable of generating an aerosol density of at least about 2000 Units for at least about 50% of the puffs, preferably for at least about 80% of the puffs (under 50/30 smoking conditions).

24 Claims, 5 Drawing Sheets

U.S. PATENT DOCUMENTS

| | | | |
|---|---|---|---|
| 4,870,748 | 10/1989 | Hensgen et al. | 29/773 |
| 4,881,556 | 11/1989 | Clearman et al. | 131/359 |
| 4,889,143 | 12/1989 | Pryor et al. | 131/331 |
| 4,893,637 | 1/1990 | Hancock et al. | 131/280 |
| 4,893,639 | 1/1990 | White | 131/369 |
| 4,903,714 | 2/1990 | Barnes et al. | 131/335 |
| 4,917,128 | 4/1990 | Clearman et al. | 131/359 |
| 4,928,714 | 5/1990 | Shannon | 131/359 |
| 4,938,238 | 7/1990 | Barnes et al. | 131/365 |
| 4,989,619 | 2/1991 | Clearman et al. | 131/194 |
| 4,991,596 | 2/1991 | Lawrence et al. | 131/194 |
| 5,016,654 | 5/1991 | Bernasek et al. | 131/290 |
| 5,019,122 | 5/1991 | Clearman et al. | 131/194 |
| 5,020,548 | 6/1991 | Farrier et al. | 131/194 |
| 5,025,814 | 6/1991 | Raker | 131/331 |
| 5,027,836 | 7/1991 | Shannon et al. | 131/194 |
| 5,027,837 | 7/1991 | Clearman et al. | 131/359 |
| 5,033,483 | 7/1991 | Clearman et al. | 131/194 |
| 5,038,802 | 8/1991 | White et al. | 131/297 |
| 5,042,509 | 8/1991 | Banerjee et al. | 131/71 |
| 5,052,413 | 10/1991 | Baker et al. | 131/77 |
| 5,060,666 | 10/1991 | Clearman et al. | 131/194 |
| 5,065,776 | 11/1991 | Lawson et al. | 131/365 |
| 5,067,499 | 11/1991 | Banerjee et al. | 131/194 |
| 5,074,320 | 12/1991 | Jones et al. | 131/331 |
| 5,076,292 | 12/1991 | Sensabaugh, Jr. et al. | 131/194 |
| 5,076,297 | 12/1991 | Farrier et al. | 131/369 |
| 5,099,861 | 3/1992 | Clearman et al. | 131/194 |
| 5,105,838 | 4/1992 | White et al. | 131/365 |
| 5,161,549 | 11/1992 | Rosario | 131/331 |
| 5,183,062 | 2/1993 | Clearman et al. | 131/194 |

CIGARETTE WITH IMPROVED SUBSTRATE

CROSS-REFERENCE TO RELATED APPLICATIONS

This application is a continuation-in-part of copending application Ser. No. 07/655,706, filed Feb. 14, 1991, now U.S. Pat. No. 5,203,355, the disclosure of which is hereby incorporated herein by reference.

FIELD OF THE INVENTION

The present invention is directed to improvements in smoking articles, particularly smoking articles employing tobacco. Cigarettes, cigars and pipes are popular smoking articles which use tobacco in various forms. Many products have been proposed as improvements upon, or alternatives to, the various popular smoking articles. For example, numerous references have proposed articles which generate a flavored vapor and/or a visible aerosol. Most of such articles have employed a combustible fuel source to provide an aerosol and/or to heat an aerosol forming material. See, for example, the background art cited in U.S. Pat. No. 4,714,082 to Banerjee et al.

BACKGROUND OF THE INVENTION

The present invention relates to smoking articles such as cigarettes, and in particular to those smoking articles having a short fuel element and a physically separate aerosol generating means. Smoking articles of this type, as well as materials, methods and/or apparatus useful therein and/or for preparing them, are described in the following U.S. Pat. No. 4,708,151 to Shelar, No. 4,714,082 to Banerjee et al., No. 4,732,168 to Resce, No. 4,756,318 to Clearman et al., No. 4,782,644 to Haarer et al., No. 4,793,365 to Sensabaugh et al., No. 4,802,568 to Haarer et al., No. 4,827,950 to Banerjee et al., No. 4,854,331 to Banerjee et al., No. 4,858,630 to Banerjee et al., No. 4,870,748 to Hensgen et al., No. 4,881,556 to Clearman et al., No. 4,893,637 to Hancock et al., No. 4,893,639 to White, No. 4,903,714 to Barnes et al., No. 4,917,128 to Clearman et al., No. 4,928,714 to Shannon, No. 4,938,238 to Hancock et al., No. 4,989,619 to Clearman et al., No. 5,016,654 to Bernasek et al., No. 5,019,122 to Clearman et al., No. 5,020,548 to Farrier et al., No. 5,027,836 to Shannon et al., No. 5,027,837 to Clearman et al., No. 5,033,483 to Clearman et al., No. 5,038,802 to White et al., No. 5,042,509 to Banerjee et al., No. 5,052,413 to Baker et al., No. 5,060,666 to Clearman et al., No. 5,065,776 to Lawson et al., No. 5,067,499 to Banerjee et al., No. 5,076,292 to Sensabaugh, Jr. et al., No. 5,076,297 to Farrier et al., and No. 5,099,861 to Clearman et al., as well as in the monograph entitled *Chemical and Biological Studies of New Cigarette Prototypes That Heat Instead of Burn Tobacco*, R. J. Reynolds Tobacco Company, 1988 (hereinafter "RJR Monograph"). These smoking articles are capable of providing the smoker with the pleasures of smoking (e.g., smoking taste, feel, satisfaction, and the like). Such smoking articles also typically provide low yields of visible sidestream smoke as well as low yields of FTC tar when smoked.

The smoking articles described in the aforesaid patents and/or publications generally employ a combustible fuel element for heat generation and an aerosol generating means, positioned physically separate from, and typically in a heat exchange relationship with the fuel element. Many of these aerosol generating means employ a substrate or carrier for one or more aerosol forming materials, e.g., polyhydric alcohols, such as glycerin. As the substrate material is heated by the burning of the fuel element, the aerosol forming materials are volatilized and released therefrom to form an aerosol.

Some of the substrates used previously comprised heat stable materials, i.e., materials which can not burn or decompose appreciably when subjected to the heat generated by the burning fuel element. Such materials include adsorbent carbons, such as porous grade carbons, graphite, activated carbons, or non-activated carbons, and the like. Other heat stable materials include inorganic solids, such as ceramics, glass, alumina, vermiculite, clays such as bentonite, and the like.

Other substrate materials used previously have comprised cellulosic materials, e.g., paper, tobacco paper and the like, rolled or randomly gathered to provide a substrate segment having an evaporative surface and a reservoir area. As hot gases from the burning fuel element contact the evaporative surface, aerosol forming materials are depleted from therefrom, but at the same time, they are replenished through wicking action from the reservoir area. Such materials typically require a large amount of aerosol former to be present on the substrate to prevent scorching or burning.

It would be advantageous to have a substrate for smoking articles, particularly cigarettes, which, without the need for bearing excessive amounts of aerosol forming materials, would not scorch or burn appreciably during use. However, such a substrate would have to hold sufficient aerosol forming materials to provide aerosol over the 10–15 puff life of a cigarette. It would also be desirable that such a substrate would be stable during storage, i.e., the aerosol forming materials would not appreciably migrate therefrom, e.g., to the other parts of the smoking article. Finally, it would be advantageous that such a substrate would be capable of being manipulated using conventional cigarette making equipment.

These and other desirable attributes of smoking articles, and particularly cigarettes, are provided by the smoking articles of the present invention, which utilize an improved substrate as described below.

SUMMARY OF THE INVENTION

It has been discovered that aerosol delivery from the paper substrates of the present invention is exponentially correlated to the temperature or energy of the puff. During the 10 to 15 puffs typically generated by the cigarettes of the present invention, the aerosol delivery potential of the paper substrate preferably remains nearly constant. Thus, if a constant energy level is delivered to the substrate, a uniform delivery of aerosol will be achieved.

The substrates of the present invention contain one or more cellulosic materials such as tobacco, wood pulp, or the like, which are formed into nonwoven sheets or webs of paper. The basis weight of the paper and the width of the paper web per unit cross sectional area presented to the heated gases drawn through the substrate during puffing are important factors in providing a sufficient and uniform aerosol delivery. Lower basis weight papers allow the gathering of greater paper widths, thereby permitting the formation of substrates having more efficient heat exchange characteristics.

Typically the basis weight of the paper should be from about 10 to about 90 grams/square meter (abbreviated $g/m^2$ or gsm), more preferably from about 15 to about 60 gsm, and most preferably from about 30 to about 40 gsm. The linear width of the paper web will depend upon the rod area to be filled and normally will range between about 25 mm to about 305 mm, while the diameter of the substrate rod may range from about 4 mm to about 8 mm. If a 4.5 mm diameter rod is desired, the width of the web will be in the range of from about 25 mm to about 125 mm, preferably from about 50 mm to about 90 mm. If a 7.5 mm diameter rod is desired, the range of the width of the web will be from about 125 mm to about 305 mm, preferably from about 150 mm to about 200 mm.

It has been found that the width per rod area of the substrate web is preferably between about 2 $mm/mm^2$ to about 7 $mm/mm^2$, and more preferably between about 3 mm per $mm^2$ and about 5 $mm/mm^2$.

In addition, the unit weight of the substrate is a factor to be considered based on the energy available thereto during a puff. The lower the unit weight, the lower the heat capacity of the substrate. Thus, less energy will be required to heat up the substrate before the aerosol former is vaporized. Substrates having a low unit weight also permit flexibility in the final substrate and/or cigarette design. For instance, the use of a low unit weight substrate can permit the use of additional materials (e.g., more tobacco in the cigarette, or burn retardant materials in the substrate) while preserving prescribed weight limitations.

Preferably, the substrates of the present invention will have a dry (i.e., no aerosol former) unit weight ranging from about 2 to about 12 mg/mm of length, preferably from about 4 to about 9 mg/mm of length, and most preferably from about 5 to about 8 mg/mm of length.

Another factor of importance herein is the density of the paper used to form the substrate. The density of the paper is related to the absorbency of the substrate. It is believed that a more dense paper will permit the use of less aerosol former, thereby reducing the unit weight of the loaded substrate and the possibility of the aerosol former migrating from the substrate to other components of the cigarette.

Preferably the paper density will range between about 0.23 g/cc to about 3.5 g/cc. As the density of the paper increases, its wetability increases (i.e., its coating characteristics) and its wicking characteristics decrease. The more preferred densities are between about 0.35 g/cc and about 2.5 g/cc, which provides a good combination of both wicking and wetability characteristics of the paper.

The pressure drop of the substrate can be in a fairly broad range to give sufficient aerosol delivery. Thus, the pressure drop of the substrate can be varied to adjust the pressure drop of a lit cigarette to predetermined ranges. For example, if the pressure drop of another component of the cigarette is high (e.g., in the fuel section), the pressure drop of the lit cigarette can be reduced by manipulating the pressure drop of the substrate without affecting the aerosol delivery. The pressure drop of the substrate can be controlled by a number of factors such as the basis weight of the paper and the width of the substrate web.

Another factor which assists in controlling the pressure drop is the architecture of the gathered substrate rod (i.e., the manner in which the substrate web fills the rod). It has been found that by embossing or scoring the web with lines parallel to the machine direction (MD) or length before the gathering operation, the web will gather in a more uniform pattern. Normally, a more highly embossed web will produce a substrate with a higher pressure drop as long as other factors such as basis weight and web width are maintained constant. Thus, a higher basis weight, narrower web will require more embossing than a lower basis weight, wider web to produce the same unit weight substrate. The degree of embossing or scoring can be varied by the number of embossing or scoring lines per unit width and/or by the depth of the embossing or scoring lines.

Preferred substrates of the present invention have a substrate pressure drop of from about 2 to about 40 mm of water and more preferably from about 5 to about 20 mm of water as measured using a 10 mm long, 7.5 mm diameter substrate rod, under FTC conditions.

An additional factor which can be used to enhance the performance of the substrate of the present invention, is the use of water-insoluble hydrated fillers in the paper, the application of a coating to the paper with water-soluble hydrated salts, or a combination thereof. The use of the hydrated fillers or salts tends to reduce the amount of scorching of the substrate and permits the use of less aerosol former.

To reduce the tendency of the substrate to scorch, it has been found that a hydrated salt filler in the paper at about 50 percent by weight or less is preferred, more preferred the filler is present at about 20 to about 40 percent by weight. When using a hydrated salt coating on the paper, a preferred range is between about 10 to about 30 percent added weight per substrate and most preferably between about 15 to about 25 percent of added weight.

As described above, the raw material used for the substrate papers is a cellulosic material. One cellulosic material advantageously employed herein comprises wood pulp as at least 50 percent (by weight) of the composition. Other suitable pulp-like materials may be employed therewith or substituted therefor, e.g., tobacco parts, other fibrous pulp-like materials, e.g., abaca (Manila hemp) plant fibers, and the like.

It has been further been discovered that the low basis weight wood pulp-like substrates of the present invention can be filled, treated or otherwise modified (e.g., coated) so as to reduce their propensity toward scorching or burning when employed in smoking articles, by the addition of one or more burn retardant compounds as a filler, coating, treatment, etc. Two types of compounds have been identified herein, water-insoluble fillers, and water-soluble salts, each of which is preferably a hydrated material, i.e., a compound having water(s) of hydration associated therewith.

Preferred burn retardant water-soluble salts useful as coatings on the substrate papers include the following compounds, most preferably in one of their hydrated forms: $CaCl_2$, $MgCl_2$, $MgSO_4$, $Na_2CO_3$, NaOAc, $FeSO_4$, $Na_2B_4O_2$, $Al(SO_4)_3$, $Na_2SiO_3$, $ZnSO_4$, and the like.

Preferred burn retardant water-insoluble compounds, which are especially useful as fillers in the substrate papers, include $CaSO_4$, $Mg(OH)_2$, $MgCO_3$, $Al_2O_3$, $FeCO_3$, $FeC_2O_4$, $Fe_2O_3$, $Mg(BO_2)_2$, $Na_2B_4O_7$, $ZnC_2O_4$, $Zn(PO_4)_2$, and the like.

While not wishing to be bound by theory, the improved performance of the hydrated materials over non-hydrated materials is believed due to the release of the water(s) of hydration to the incoming hot gas stream generated by the burning fuel element. The preferred hydrated salts have been selected for their propensity to release water at temperatures ranging from about 35° C. to 300° C., preferably at from about 100° C. to about 200° C. If desired, mixtures of one or more hydrated salts may be employed as fillers to give a wide temperature profile of water release. The release of water from the hydrated salts on the substrate keeps the paper or cellulose-based substrate base materials relatively cool, and prevents substantial scorching or burning thereof.

In another embodiment of the present invention, cigarettes are provided which utilize the substrates of the present invention therein. These cigarettes generally comprise a combustible heat source (or fuel element), a physically separate aerosol generating means which includes the substrate of the present invention, and a mouthend piece. In such cigarettes the fuel element produces heat which is furnished to the substrate in the aerosol generating means. As the substrate is heated, volatile aerosol forming materials are liberated, which in turn are delivered to the smoker through the mouthend piece in the form of a smoke-like aerosol.

In another embodiment of the present invention, a process for forming paper substrate rods is provided. This process, which is a gathering process, involves a modification to the web gathering equipment used to make filters which is described in detail in U.S. Pat. No. 4,807,809 to Pryor et al. , the disclosure of which is hereby incorporated herein by reference.

A preferred modification to the Pryor et al. apparatus comprises the addition of a paper embossing or scoring means to the unwind station. Before the paper web enters the gathering funnel, it travels through paper embossing or scoring means, advantageously comprising a set of grooved rolls which score or emboss the web. As discussed above, the grooves on the rolls may be varied in both number, width, and depth, thereby enabling the formation of variable degrees of scoring on the paper from fine scoring to coarse scoring. This scoring or embossing helps the paper to fill the rod uniformly, eliminating large holes as it is gathered into a rod using the Pryor et al. apparatus. By changing the degree of scoring, one can vary the pressure drop of the resulting paper substrate rod.

Several terms are employed in the detailed description of the invention which follows, for which definitions may be beneficial to the reader. Thus:

As used herein, the term "peak air temperature" is defined as the maximum temperature of air delivered to the substrate during a 2 sec. puff on a smoking machine employing 50/30 smoking conditions—i.e., smoking conditions comprising a 50 cc puff volume of 2 sec. duration, separated by a 28 sec. smolder time interval.

As used herein, the term "substrate pressure drop" is defined as the measured pressure drop of an unloaded substrate rod, in mm of $H_2O$, as measured at an air flow rate of 17.5 cc/sec.

As used herein, the term "lit pressure drop" is defined as the maximum measured pressure drop of a whole cigarette, in mm of $H_2O$, as measured during a 2 sec. puff on a smoking machine employing 50/30 smoking conditions.

As used herein, the term "wood pulp-like" is meant to include those cellulosic substrate base materials which have a consistency and workability similar to wood pulp, based upon having long fibers, etc.

As used herein, the term "aerosol" is meant to include vapors, gases, particles, and the like, both visible and invisible, and especially those components perceived by the smoker to be "smoke-like," formed by the action of heat generated by the fuel element upon materials contained within the aerosol generating means, or elsewhere in the smoking article.

As used herein, the term "carbonaceous" means comprising primarily carbon.

All percentages given herein are by weight, and all weight percentages given herein are based on the final composition weights, unless otherwise noted.

DETAILED DESCRIPTION OF THE PREFERRED EMBODIMENTS

As described above, the present invention is particularly directed to a substrate useful in smoking articles, such as those described in U.S. Pat. Nos. 4,793,365; 4,928,714; 4,714,082; 4,756,318; 4,854,331; 4,708,151; 4,732,168; 4,893,639; 4,827,950; 4,858,630; 4,938,238; 4,903,714; 4,917,128; 4,881,556; 4,991,596; 5,027,837; U.S. patent application Ser. No. 07/642,233, filed Jan. 23, 1991, No. 07/713,939, filed Jun. 12, 1991, and No. 07/723,350, filed Jun. 28, 1991, which are hereby incorporated herein by reference. See also, European Patent Publication No. 342,538.

Figure 1:
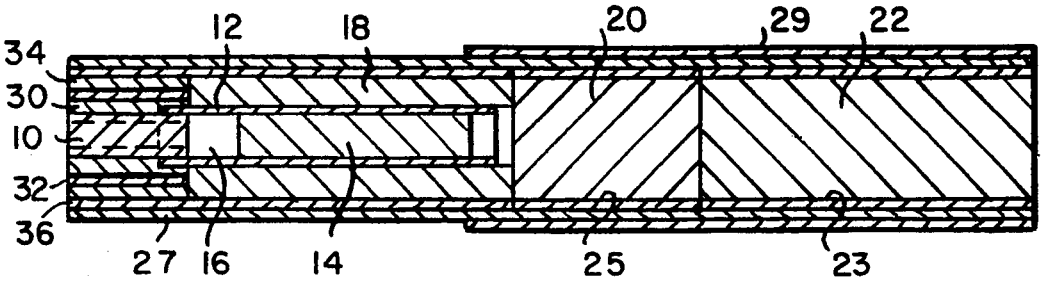
FIG. 1 is a sectional illustration of one configuration of a cigarette including a substrate of the present invention.
Figure 1A:
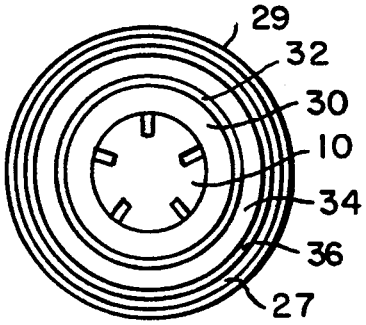
FIG. 1A is an end view of the cigarette shown in FIG. 1.

FIGS. 1 and 1A illustrate a cigarette having a carbonaceous fuel element 10, circumscribed by a jacket comprising alternating layers of glass fibers 30 and 34 and tobacco paper 32 and 36. Located longitudinally behind the fuel element, and in contact with a portion of the rear periphery thereof is a sleeve 12. The sleeve carries the substrate material 14 of the present invention, which comprises a low mass cellulosic base material retaining one or more aerosol forming materials and is spaced from the fuel element, forming gap 16. Surrounding the sleeve 12 is a roll of tobacco 18 in cut-filler form. The mouthend piece of the cigarette is comprised of two parts, a tobacco paper segment 20 and a low efficiency polypropylene filter material 22. As illustrated several paper layers 23, 25, 27 and 29, are employed to hold the cigarette and/or its individual components together.

Heat from the burning fuel element is transferred by conduction and convection to the substrate in the sleeve. The aerosol forming materials carried by the substrate are vaporized and, upon cooling, these vapors condense to form a smoke-like aerosol which is drawn through the smoking article, absorbing additional tobacco and other flavors from the other components of the smoking article.

Figure 2:
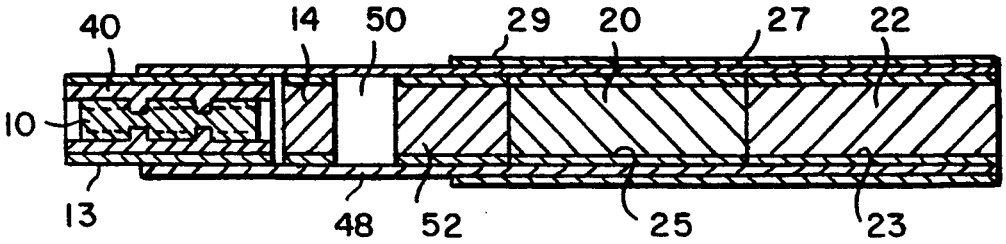
FIG. 2 illustrates in sectional view, another embodiment of a cigarette including a substrate of the present invention.
Figure 2A:
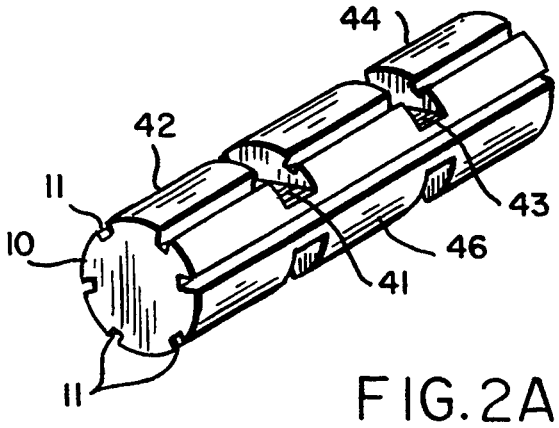
FIG. 2A is a top plan view of the fuel element used in the cigarette shown in FIG. 2.

Referring in detail to FIGS. 2 and 2A, there are respectively illustrated another embodiment of the cigarette of the present invention and a symmetrical fuel element therefor. As illustrated, the cigarette includes a segmented fuel element 10 circumscribed and recessed within a retaining jacket of insulating material 40. The insulating and retaining jacket material 40 comprises glass fibers.

As illustrated in FIG. 2A, the fuel element 10, has a generally cylindrical shape and has several longitudinally extending peripheral channels 11. The fuel element has a segmented design which includes three longitudinally positioned portions or segments, consisting of two end portions 42 and 44 and one intermediate portion 46. When positioned in the cigarette of FIG. 2, one of the end portions 42 or 44 serves as the burning segment, while other 44 or 42 serves as the base segment. Intermediate segment 46 is separated (i.e., isolated) from each of the end segments by two areas of reduced cross-sectional area 41 and 43, which serve as isolation segments.

As shown in FIG. 2, the insulating and retaining jacket 40 circumscribes the longitudinal periphery of fuel element 10 and extends beyond each end of the fuel element, such that the fuel element is recessed within the insulating and retaining jacket. Such placement assists in the retaining function of the jacket. Preferred fibrous (e.g., glass fibers) jackets shrink slightly when exposed to the heat of the burning fuel element, thereby further surrounding the fuel element and retaining it in place. The recess may be achieved utilizing the manufacturing process disclosed in U.S. patent application Ser. No. 07/723,350, filed Jun. 28, 1991, the disclosure of which is incorporated herein by reference.

Situated longitudinally behind the fuel element 10 is an aerosol generating means, which comprises a substrate 14 as described herein. The substrate typically includes one or more hydrated inorganic salts, together with one or more aerosol forming materials and flavor components.

As heat from the burning fuel element reaches the substrate, the waters of hydration are released from the salts on the substrate base material, cooling the same and preventing appreciable scorching and/or burning. At about the same time, the aerosol forming materials are volatilized by the heat from the burning of the fuel element. As illustrated, the substrate 14 is positioned within the cigarette at a location remote from the rear end of the fuel element 10. This spaced apart relationship aids in preventing migration of the aerosol forming material(s) from the substrate to the fuel element and also assists in preventing the substrate from scorching or burning.

Surrounding the insulating and retaining jacket 40 is an air permeable paper wrapper 13. Wrapper 13 may comprise one layer or it may be prepared from two separate layers, each having different porosity and ash stability characteristics. Circumscribing the insulated fuel element at about the junction of the burning segment 42 and the isolation segment 41, and extending back over the substrate 14 is a non-burning or foil-backed (e.g., aluminum or other metal) paper wrapper 48. Wrapper 48 is preferably a non-wicking material which prevents the wicking of the aerosol forming material(s) on the substrate 14 to the fuel element 10, the insulating jacket 40, and/or from staining of the other components of the front end assembly. This wrapper also minimizes or prevents peripheral air (i.e., radial air) from flowing to the segments of the fuel element disposed longitudinally behind the burning segment, thereby causing oxygen deprivation and preventing excessive combustion. While not preferred, wrapper 48 may extend over the burning end of the fuel element 10 (or beyond the same) and be provided with a plurality of perforations (not shown) to allow controlled radial air flow to the burning segment of the fuel element to support combustion.

Situated longitudinally behind the substrate 14 is a void space 50. Void space 50 acts as a cooling and nucleation chamber wherein the hot volatile materials exiting the substrate cool down and form an aerosol. Void space 50 may be partially or completely filled, e.g., as shown at 52 with tobacco or reconstituted tobacco, e.g., in cut filler form, or with other tobacco materials, e.g., tobacco paper and the like, to contribute additional tobacco flavors to the aerosol.

Positioned at the extreme mouth end of the cigarette is a two part mouthend piece comprising (i) a rod or roll of tobacco, such as tobacco paper 20 and (ii) a low-efficiency filter element 22 including a filter material, such as a gathered web of non-woven polypropylene fibers.

Each of the above described elements of the cigarette of the present invention is generally provided with a paper overwrap, and individual overwrapped segments are typically combined by the use of paper overwraps. Advantageously, the paper overwrap of the substrate is a non-wicking paper. These papers are shown in FIG. 2 as reference numbers 23–29.

As illustrated in FIGS. 1 & 2, the substrate is positioned behind the fuel element, in a spaced apart relationship relative to the back end of the fuel element so as to have an air space or gap therebetween. This can be accomplished by abutting the substrate against the insulating jacket or by providing a gap or space between the jacketed fuel element and the substrate during manufacture. If desired, the back end of the fuel element and the front end of the substrate may be spaced from about 1 mm to about 10 mm apart, preferably from about 2 mm to about 5 mm apart.

Figure 3:
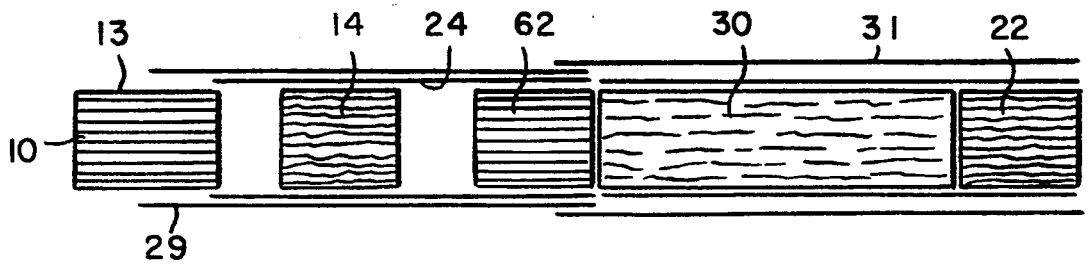
FIG. 3 illustrates in sectional view, another embodiment of a cigarette including a substrate of the present invention.

FIG. 3 illustrates another embodiment of a cigarette which can utilize the substrates of the present invention. As illustrated, a multi-part insulating and retaining jacket circumscribes the longitudinal periphery of fuel element 10. The fuel element 10 may be extruded into the insulating jacket material as set forth in U.S. patent application Ser. No. 07/856,239, filed Mar. 25, 1992, the disclosure of which is incorporated herein by reference.

Figure 3A:
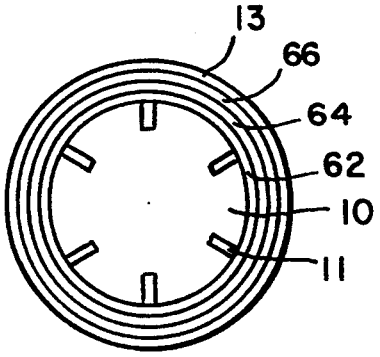
FIG. 3A is an end view of the cigarette shown in FIG. 3.

As illustrated in FIG. 3A, the multi-part insulating jacket comprises alternating layers of glass fibers and tobacco paper, arranged as concentric rings emanating outwardly from the fuel element in the following order; (a) glass fiber mat 62; (b) tobacco paper 64; and (c) glass fiber mat 66; and an outer paper wrapper 13.

Situated behind and spaced apart from the insulated fuel element 10, is the aerosol generating means, which comprises the substrate 14, prepared as described herein. In this embodiment, the preferred heat-stabilized nature of the substrate (via hydrated salts), in conjunction with the void space between the rear of fuel element 10 and the front face of the substrate 14 are factors which help to prevent scorching of the substrate as well as migration of the aerosol forming materials out of the aerosol generating means into other components of the cigarette. As with the previous embodiments, the heat stabilized nature of substrate 14 is provided by one or more hydrated salts and one or more aerosol forming materials. Additionally flavor components can be added to the substrate.

The wrapper 13 may comprise one layer or may be prepared from a plurality of separate layers, each having different porosity and ash stability characteristics. Circumscribing the insulated fuel element, at a point about 2 to 8 mm from the lighting end of the cigarette, is a non-burning or foil-backed (e.g., aluminum or other metal) paper wrapper 29. Wrapper 29 is preferably a non-wicking material which prevents the wicking of the aerosol forming material(s) on the substrate 14 to the fuel element 10, the insulating jacket, and/or from staining of the other components of the front end assembly. This wrapper also minimizes or prevents peripheral air (i.e., radial air) from flowing to the portion of the fuel element disposed longitudinally behind its forward edge, thereby causing oxygen deprivation and preventing excessive combustion.

Spaced longitudinally behind substrate 14 is a segment of tobacco paper 62. This tobacco paper generally provides tobacco flavors to the aerosol emitted from the aerosol generating means. The segment 62 can be omitted if desired and a void space substituted therefor. The substrate 14 and the tobacco paper 62 are overwrapped with a paper overwrap 24 which advantageously is treated (e.g., coated) to prevent migration of the aerosol former. Another paper overwrap 25 combines this segment with the frontend piece (i.e., the wrapped, insulated fuel element).

Positioned at the extreme mouth end of the cigarette is a two part mouthend piece comprising (i) a rod or roll of tobacco, such as tobacco cut filler 20 and (ii) a low-efficiency filter element 22 including a filter material, such as a gathered web of non-woven polypropylene fibers. A tipping paper 31 is used to join the mouthend piece to the joined frontend assembly—i.e., the fuel and substrate combination.

The substrates of the present invention retain aerosol forming materials and other ingredients, e.g., flavorants and the like, which upon exposure to heated gases passing through the aerosol generating means during puffing, are vaporized and delivered to the user as a smoke-like aerosol. Especially preferred aerosol forming materials used herein include glycerin, propylene glycol, water, and the like, flavorants, and other optional ingredients.

The substrate rods of the present invention are advantageously formed using commercially available equipment, particularly cigarette filter making equipment, or cigarette rod forming equipment. Two especially preferred commercially available apparatus useful in forming the substrates of the present invention are the DeCoufle filter making equipment (CU-10 or CU2OS) available from DeCoufle s.a.r.b. (Process D) and a modified rod forming apparatus, the KDF-2, available from Haunie-Werke Korber & Co., KG (Process G).

Figure 4:
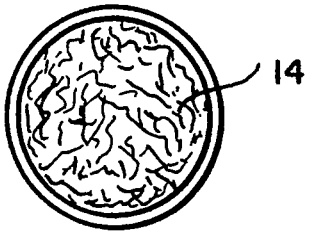
FIG. 4 is an end view of one preferred architecture of a substrate of the present invention.

The commercial equipment is advantageously modified or adapted so that a scoring or embossing of the paper is carried out before any gathering occurs. This procedure eliminates large void spaces and provides a substrate rod with a more uniform longitudinal channel architecture (see, FIG. 4).

It has been discovered that the degree of embossing is directly proportional to the pressure drop of the finished substrate rod. As described above, the pressure drop of the substrate element can be used to control the overall pressure drop of the finished cigarette. If more pressure drop is required, the substrate rod pressure drop can be increased by increasing the degree of embossing. Likewise, if other components contribute a higher pressure drop than desired, the pressure drop contributed by the substrate can be reduced, by decreasing the amount of embossing.

Figure 5:
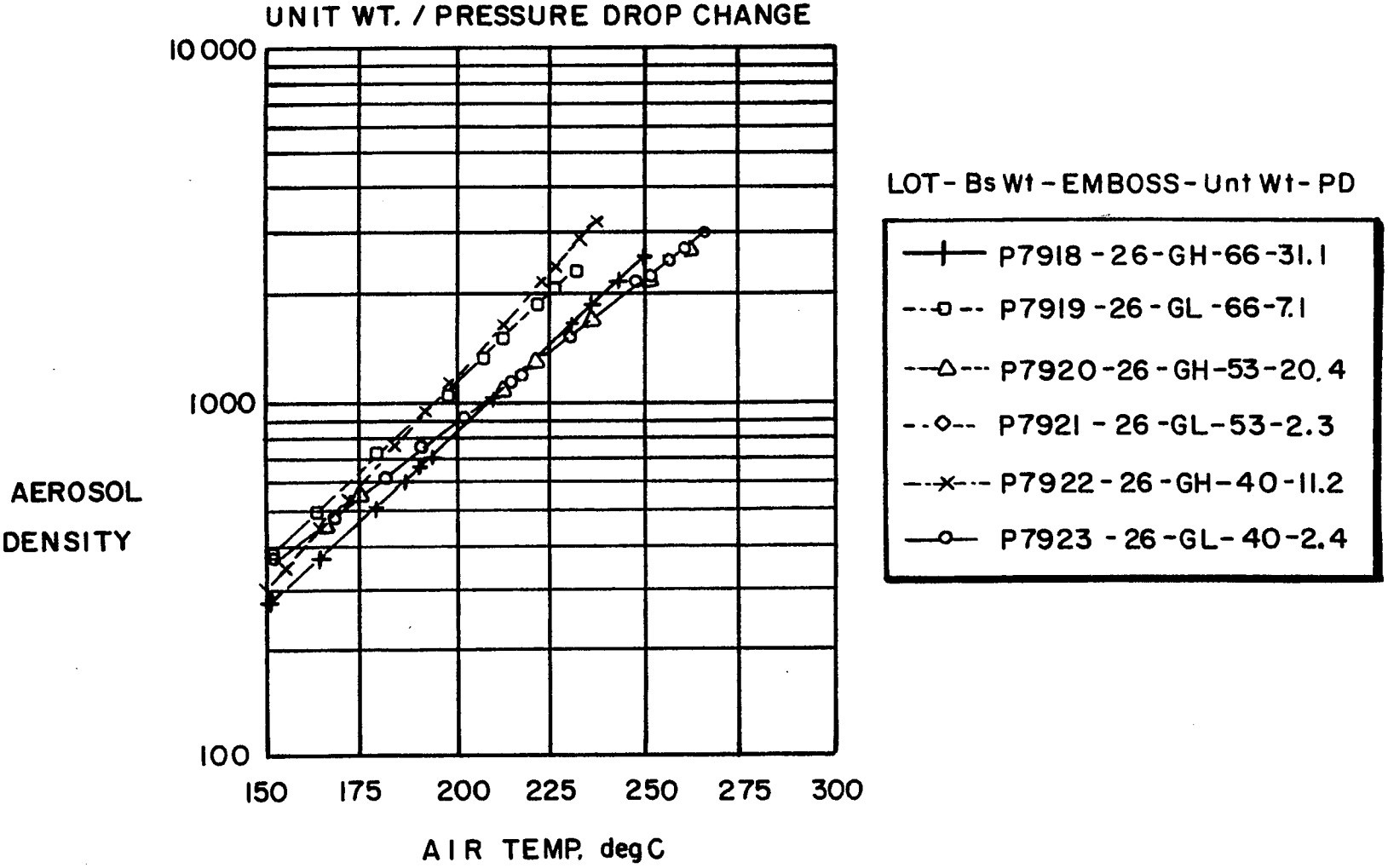
FIG. 5 graphically illustrates aerosol density values in a substrate/fuel element fixture versus substrate peak air temperature, for three substrate pairs (each pair having the same unit weight) but having different pressure drops due to low or heavy embossing. The G designates the KDF-2 equipment while the D designates the DeCoufle equipment.
Figure 6:
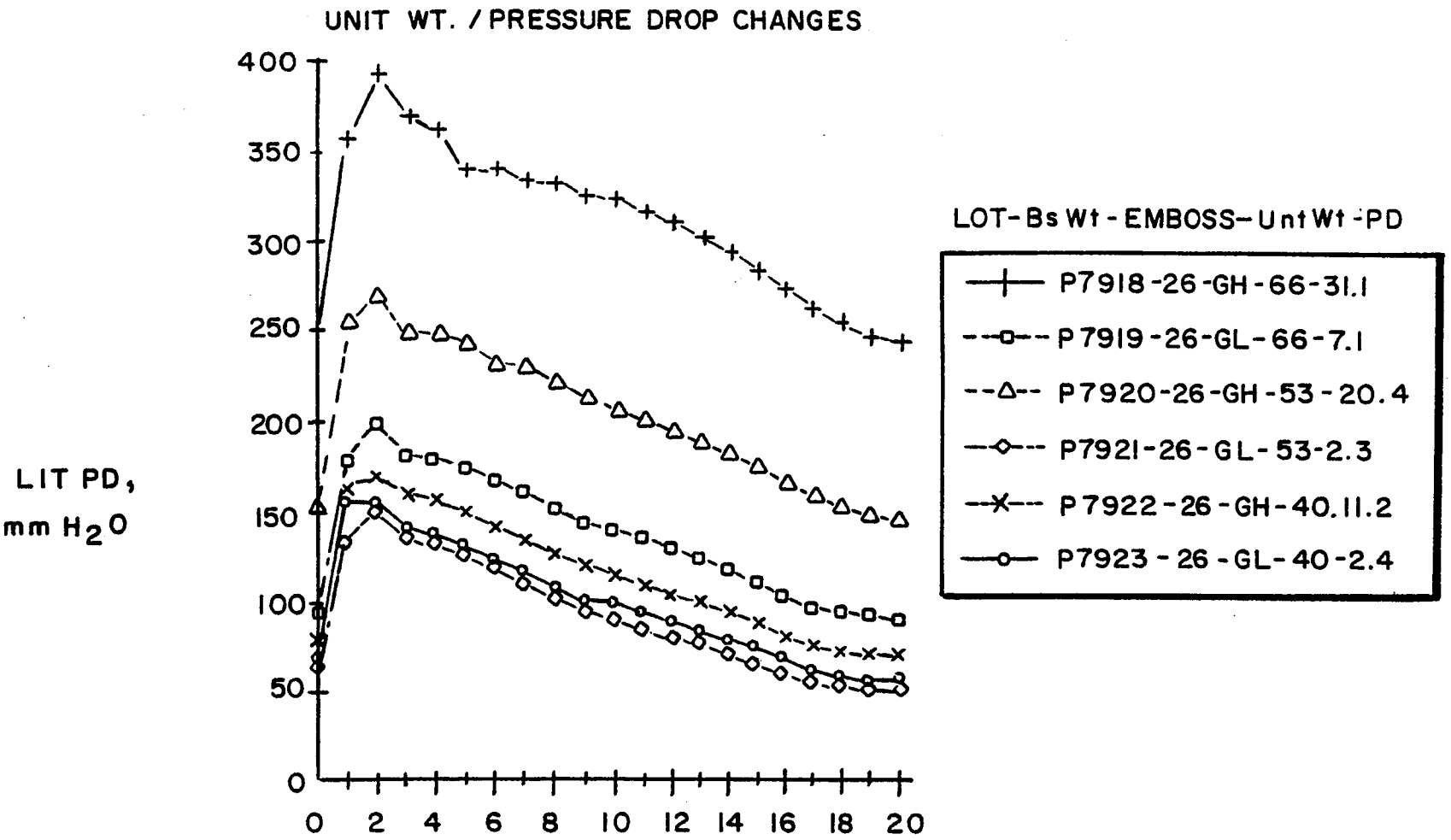
FIG. 6 graphically illustrates the lit pressure drop values in a substrate/fuel element fixture versus puff number, for three pairs of substrate papers having the same basis weight (all 26 gsm) but having different unit weights and pressure drops due to low or heavy embossing.
Figure 7:
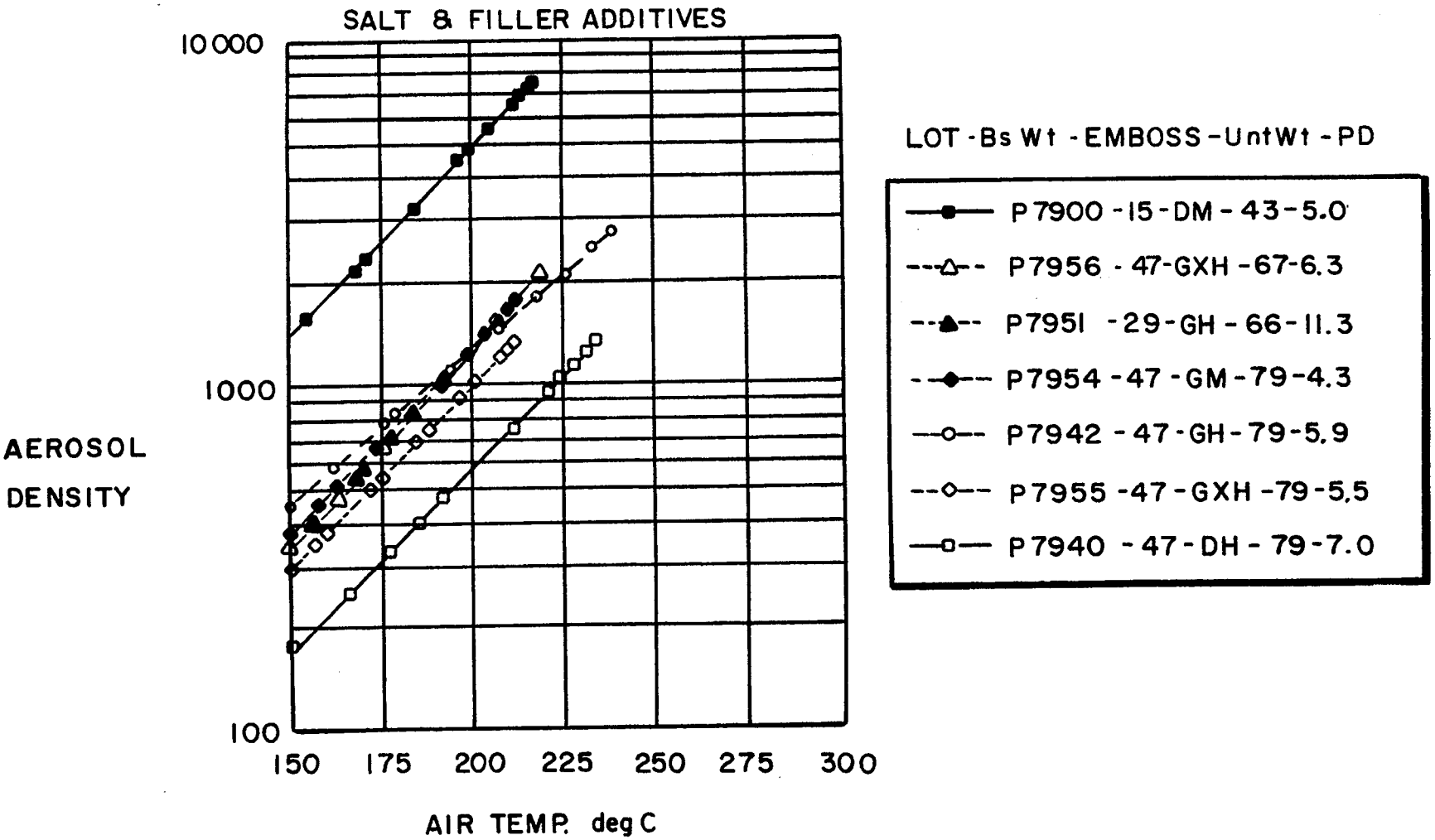
FIG. 7 graphically illustrates aerosol density values in a substrate/fuel element fixture versus substrate peak air temperature, for substrates treated with hydrated salts or fillers.

Table I shows the characteristics of a number of substrates of the present invention and FIGS. 5–7 graphically illustrate testing regimes conducted on some of these substrates. In Table I, the Code Number corresponds to the Lot Number reflected in the Figures.

TABLE I

| | | PAPER SUBSTRATE CHARACTERISTICS | | | | | |
|---|---|---|---|---|---|---|---|
| CODE | PAPER | BASIS WT gsm | WIDTH mm | UNIT WT mg/10 mm | PROCESS | EMBOSS/ CRIMP | UNIT PO mm-2C |
| P7900 | 2-1073-C-01C | 15 | 225 | 43 | D | M | 5.0 |
| P7901 | P1976-58-1 | 25 | 254 | 66 | D | L | 2.1 |
| P7902 | P1976-58-1 | 25 | 254 | 66 | D | M | 25.3 |
| P7903 | P1976-58-5 | 86 | 88 | 73 | D | M | 0.6 |
| P7904 | P1976-58-5 | 86 | 85 | 73 | D | H | 2.0 |
| P7905 | P3122-135 22% REG. EXTRACT | 44 | 165 | 91 | D | M | |
| P7906 | -3122-138 18% ENZYME EXTRACT | 44 | 165 | 8 | D | M | |
| P7907 | P1976-58-1 | 26 | 254 | 66 | D | M | 17.0 |
| P7908 | P1976-58-1 | 26 | 203 | 53 | D | H | 11.0 |
| P7909 | P1976-58-1 | 25 | 203 | 53 | D | L | 9.4 |
| P7912 | P1976-58-2 | 44 | 166 | 73 | D | H | 21.4 |
| P7913 | P1976-58-2 | 44 | 166 | 73 | D | L | 11.6 |
| P7914 | P1976-58-3 | 56 | 130 | 73 | D | H | 14.6 |

TABLE I-continued

| CODE | PAPER | PAPER SUBSTRATE CHARACTERISTICS BASIS WT gsm | WIDTH mm | UNIT WT mg/10 mm | PROCESS | EMBOSS/ CRIMP | UNIT PO mm-2C |
|---|---|---|---|---|---|---|---|
| P7916 | P1976-58-5 | 74 | 99 | 73 | D | H | 8.0 |
| P7918 | P1976-58-1 | 26 | 254 | 66 | G | H | 31.1 |
| P7919 | P1976-58-1 | 26 | 254 | 66 | G | L | 7.1 |
| P7920 | P1976-58-1 | 26 | 203 | 53 | G | H | 20.4 |
| P7921 | P1976-58-1 | 26 | 203 | 53 | G | L | 2.3 |
| P7922 | P1976-58-1 | 26 | 152 | 40 | G | H | 11.2 |
| P7923 | P1976-58-1 | 26 | 152 | 40 | G | L | 2.4 |
| P7924 | P1976-58-2 | 44 | 166 | 73 | G | H | 4.3 |
| P7925 | P1976-58-2 | 44 | 166 | 73 | G | L | 2.7 |
| P7926 | P1976-58-3 | 56 | 130 | 73 | G | H | 6.0 |
| P7927 | P1976-58-3 | 56 | 130 | 73 | G | L | 2.6 |
| P7928 | P1976-58-4 | 75 | 99 | 73 | G | H | 2.2 |
| P7929 | P1976-58-4 | 74 | 99 | 73 | G | L | 0.8 |
| P7930 | P1976-58-5 | 35 | 36 | 73 | G | L | |
| P7931 | P1976-58-5 | 35 | 86 | 73 | G | H | 1.3 |
| P7932 | P3122-169 80% $MgSO_4$ | 26–8 | 254 | 36 | G | H | 11.0 |
| P7933 | P130-d3-5 30% $CaCO_2$ | 44 | 165 | 73 | G | H | 42 |
| P7934 | P3122-169 30% $MgSO_4$ | 25–8 | 254 | 86 | D | H | 15.7 |
| Pt935 | P730-63-5 30% $CaCO_2$ | 44 | 165 | 73 | D | H | 5.0 |
| P7936 | P3122-169 30% $MgSO_4$ | 25–8 | 254 | 86 | G | L | 3.1 |
| P7937 | PT80-63-5 30% $CaCO_3$ | 44 | 165 | 73 | G | L | 1.9 |
| P7938 | 2-1079-C-01C | 15 | 225 | 43 | G | H | 9.9 |
| P7939 | 2-1079-C-01C | 15 | 225 | 43 | G | L | |
| P7940 | P3284-17 40% $CaSO_4$ | 47 | 165 | 79 | D | H | 7.0 |
| P7942 | P328417 40% $CaSO_4$ | 47 | 165 | 79 | G | H | 5.9 |
| P7943 | P328417 40% $CaSO_4$ | 47 | 165 | 79 | G | H | 2.2 |
| P7944 | P3122-169 30% $MgSO_4$ | 34 | 191 | 65 | G | L | |
| P7945 | P3122-169 30% $MgSO_4$ | 34 | 191 | 65 | G | H | |
| P7941 | P3510-12 9% $CaCl_2$ | 29 | 229 | 66 | G | H | 11.3 |
| P7954 | P328417 40% $CaSO_4$ | 47 | 165 | 79 | G | M | 4.3 |
| P7955 | P328417 40% $CaSO_4$ | 47 | 165 | 79 | G | XM | 5.5 |
| P7956 | P328417 40% $CaSO_4$ | 47 | 140 | 67 | G | XH | 6.3 |
| P7957 | P3198-11-1 1% Naico 8669 | 26 | 254 | 66 | G | H | |
| P7958 | P3198-11-1 1% Naico 8669 | 26 | 254 | 66 | G | H | |
| P7959 | P8198-11-2 0.9% Triton X-102 | 26 | 254 | 66 | G | H | |
| P7960 | P8198-11-2 0.9% Triton X-102 | 26 | 254 | 66 | G | L | |
| P7961 | P328417 40% $CaSO_4$ | 47 | 140 | 66 | G | H | |
| P7962 | P328417 40% $CaSO_4$ | 47 | 140 | 66 | G | L | |
| P7963 | P328417 40% $CaSO_4$ | 58 | 127 | 74 | G | H | |
| P7965 | P328419 25% $CaSO_4$ | 36 | 178 | 64 | G | H | |
| P7966 | P328419 25% $CaSO_4$ | 36 | 178 | 64 | G | L | |
| P7967 | P328417 40% $CaSO_4$ | 47 | 165 | 79 | G | H | 5.9 |

FIG. 5 graphically illustrates aerosol density values in a substrate/fuel element fixture versus substrate peak air temperature, for three substrate pairs (each pair having the same unit weight) but having different pressure drops due to low or heavy embossing. Each of the substrates was prepared from a paper having a 26 gsm basis weight. Pairs were determined by the width of the gathered web, 254 mm, 203, 152, respectively. Each pair was embossed either heavily (H) or lightly (L). Three different unit weights were obtained; 66 mg, 53 mg, and 40 mg. The measured pressure drops under 50/30 smoking conditions for these substrates were 31.1 vs. 7.1; 20.4 vs. 2.3; and 11.2 vs. 2.4 mm of $H_2O$ respectively. Each substrate was 10 mm long and 7.5 mm in diameter, and contained 275% by weight glycerin as the aerosol forming material.

Aerosol density as reported herein was determined using a Phoenix Precision Instruments Model JM-6500 aerosol spectrometer, available from the Virtis Company, Gardiner, N.Y. The commercial instrument was modified by removing the vacuum system, such that only the scanning cell and the near forward scattering optics were retained. This apparatus provides a voltage measurement, based upon several factors, including particle size, particle shape, refractive index, and degree of heterodispersity. Exact concentration measurements are not possible with this instrument. However, relative measurements are made and utilized as reported herein.

To determine Aerosol Density, a 50 liter/min. air dilution flow is passed through the aerosol spectrometer and a 25 ml volume of "test" aerosol is added to this air stream. The system sensitivity was adjusted so that 25 ml volume of "smoke" from a Premier cigarette (see the RJR Monograph, supra) gives a reading on the instrument of about 8,000 millivolts (mV). This value is deemed to be a very high level of aerosol density. An acceptable level of aerosol density for at least about 50 percent, and preferably for at least about 80 percent of the aerosol producing puffs of the substrates of the present invention (and cigarettes using the same) is about 2000 mV.

The results shown in FIG. 5 illustrate that changes in embossing level, that cause changes in rod pressure drop, have little impact on aerosol delivery.

FIG. 6 graphically illustrates the lit pressure drop values in a substrate/fuel element fixture versus puff number, for the same substrate pairs used in FIG. 5.

Thus, while the substrate rod pressure drop has little impact on aerosol delivery, FIG. 6 shows that changes in substrate rod pressure drop will have major impact on the lit pressure drop of cigarettes of the present invention. Substrate pressure drop can thus be used to adjust lit pressure drop.

As discussed above, one disadvantage of previously used paper substrates, is that they could scorch or burn if subjected to high fuel gas temperatures. That is particularly true for certain smokers, who can produce high temperatures in cigarettes by "over-puffing" them. For example, most smokers typically take puffs of limited duration, with comparatively long smoldering periods between puffs. Cigarettes can be "over-puffed" by taking long, frequent puffs, with comparatively short smolder periods. It is believed that certain smokers can "over-puff" cigarettes causing the substrate to suffer temperatures as high as 500° C. Substrate papers are thus needed which can resist such high temperatures, at least for a short period of time.

It has been discovered that suitable means for increasing the scorching resistance of wood pulp type substrate papers includes adding fillers to the papers and/or treating the papers with burn retarding chemicals. Especially preferred materials are hydrated salts and fillers. Several papers treated with such materials were formed into substrate rods, and the aerosol delivery characteristics thereof are shown in FIG. 7.

The substrates tested in FIG. 7 were prepared from papers having basis weights ranging from 15 to 47 gsm. These substrates were embossed either extra heavily (XH), heavily (H) or moderately (M) and several different unit weights and pressure drops were obtained. Each substrate was 10 mm long and 7.5 mm in diameter, and contained 200% by weight glycerin as the aerosol forming material.

A number of the substrates shown in Table I were evaluated in a scorching study to determine their resistance to scorching and/or burning. The scorching study was conducted using a heated air chimney with a side sampling port. A Bunsen burner was used to heat the air in this chimney from 250° C. to 500° C. Once the air temperature in the chimney stabilized, heated air could be drawn out a side port through a tube connected to a smoking machine. A substrate piece was placed in this tube, which also contained a thermocouple for measuring air temperature passing into the substrate. Substrate samples were tested at various temperatures, for various total puff numbers, both with and without a glycerin load, i.e., with and without an aerosol forming material.

Test conditions were chosen to maximize differences between the different substrates. After testing, substrate pieces were opened and the paper strip examined visually. When one stage of testing was complete, the substrates were placed in order from worst to best for scorch resistance. Table II shows the composite rankings for the three machine tests conducted.

TABLE II

PAPER SUBSTRATE SCORCHING STUDY
Rankings After Machine (50/30) Testing
(best at bottom)

| Substrate - no AF Air Temp - 270 to 300° C. | Substrate - no AF Air Temp - 350 to 370° C. | Substrate - 165% AF Air Temp - 450 to 500° C. |
|---|---|---|
| P7900 | | |
| P7922 | | |
| P7933 | | |
| P7920 | | |
| P7926 | P7918 | P7900 |
| P7918 | P7926 | P7924 |
| P7924 | P7924 | P7926 |
| P7932 | P7942 | P7932 |
| P7942 | P7932 | P7942 |

*AF = aerosol former (e.g., glycerin)

These tests indicate that substrates which contain hydrated inorganic fillers or hydrated salt coatings have increased resistance to scorching.

The fuel elements employed herein should meet three criteria; (1) they should be easy to ignite, (2) they should supply enough heat to produce aerosol for about 5–15, preferably about 8–12 puffs; and (3) they should not contribute off-taste or unpleasant aromas to the cigarette. Fuel elements prepared from a combustible composition comprising carbon and a binder, or carbon, tobacco and a binder are preferred, but other combustible compositions may be used.

The density of the preferred fuel elements is generally greater than about 0.5 g/cc, preferably greater than about 0.7 g/cc and most preferably greater than about 1 g/cc, but typically does not exceed 2 g/cc. The length of the fuel element, prior to burning, is generally less than about 25 mm, often less than about 20 mm, and is typically about 10–16 mm or less.

Exemplary carbonaceous fuel elements are described in U.S. Pat. No. 4,714,082; as well as in European Patent Publication Nos. 236,992 and 407,792; which are incorporated herein by reference. Other exemplary fuel elements can be provided from various forms of tobacco materials, as described in U.S. Pat. No. 3,931,824; U.S. patent application Ser. No. 07/569,325, filed, Aug. 17, 1990, and in Sittig, *Tobacco Substitutes*, Noyes Data Corp. (1976). Another useful fuel composition is described U.S. patent application Ser. No. 07/722,993, filed Jun. 28, 1991, the disclosure of which is hereby incorporated herein by reference.

If desired, the fuel element can be at least partially circumscribed by a liner, such as at least one layer of paper, which surrounds the peripheral length of the fuel element. One preferred liner is a tobacco paper (e.g., a tobacco/wood pulp paper available as P-2831-189-AA from Kimberly-Clark) or a carbon-containing paper (e.g., a carbon - wood pulp - tobacco stem paper available as P-2540-136E from Kimberly-Clark).

When employed in a cigarette, the fuel element is circumscribed by an insulating and/or retaining jacket material. The insulating and retaining material preferably (i) is adapted such that drawn air can pass therethrough, and (ii) is positioned and configured so as to hold the fuel element in place. Preferably, the jacket is flush with the ends of the fuel element, however, it may extend from about 0.5 mm to about 3 mm beyond each end of the fuel element.

The components of the insulating and/or retaining material which surrounds the fuel element can vary. Examples of suitable materials include glass fibers and other materials as described in U.S. Pat. No. 5,105,838; European Patent Publication No. 339,690; and pages 48–52 of the RJR Monograph, supra. Examples of other suitable insulating and/or retaining materials are glass fiber and tobacco mixtures such as those described in U.S. Pat. Nos. 5,105,838, 5,065,776 and 4,756,318; and U.S. patent application Ser. No. 07/354,605, filed May 22, 1989.

Other suitable insulating and/or retaining materials are gathered paper-type materials which are spirally wrapped or otherwise wound around the fuel element, such as those described in copending U.S. patent application Ser. No. 07/567,520, filed Aug. 15, 1990. The paper-type materials can be gathered or crimped and gathered around the fuel element; gathered into a rod using a rod making unit available as CU-10 or CU2OS from DeCoufle s.a.r.b., together with a KDF-2 rod making apparatus from Hauni-Werke Korber & Co., KG, or the apparatus described in U.S. Pat. No. 4,807,809 to Pryor et al.; wound around the fuel element about its longitudinal axis; or provided as longitudinally extending strands of paper-type sheet using the types of apparatus described in U.S. Pat. No. 4,889,143 to Pryor et al. and No. 5,025,814 to Raker, the disclosures of which are incorporated herein by reference.

Examples of paper-type sheet materials are available as P-2540-136-E carbon paper and P-2674-157 tobacco paper from Kimberly-Clark Corp.; and preferably the longitudinally extending strands of such materials (e.g., strands of about 1/32 inch width) extend along the longitude of the fuel element. The fuel element also can be circumscribed by tobacco cut filler (e.g., flue-cured tobacco cut filler treated with about 2 weight percent potassium carbonate). The number and positioning of the strands or the pattern of the gathered paper is sufficiently tight to maintain, retain or otherwise hold the fuel element within the cigarette.

As illustrated in FIGS. 1–3, the insulating and/or retaining material which surrounds the fuel element is circumscribed by a paper wrapper. Suitable papers for use herein are described in U.S. Pat. No. 4,938,238 and U.S. patent application Ser. No. 07/574,327, filed Aug. 28, 1990.

In most embodiments of the present invention, the combination of the fuel element and the substrate (also known as the front end assembly) is attached to a mouthend piece; although a disposable fuel element-/substrate combination can be employed with a separate mouthend piece, such as a reusable cigarette holder. The mouthend piece provides a passageway which channels vaporized aerosol forming materials into the mouth of the smoker; and can also provide further flavor to the vaporized aerosol forming materials. Typically, the length of the mouthend piece ranges form 40 mm to about 85 mm.

Flavor segments, i.e., segments of gathered paper or tobacco cut filler (or the like) can be incorporated in the mouthend piece, e.g., either directly behind the substrate or spaced apart therefrom, to contribute flavors to the aerosol. Gathered carbon paper can be incorporated into the mouthend piece, particularly in order to introduce menthol flavor to the aerosol. Such papers are described in European Patent Publication No. 342,538. Other flavor segments useful herein are described in U.S. patent application Ser. No. 07/414,835, filed Nov. 29, 1989, No. 07/606,287, filed Nov. 6, 1990, and No. 07/621,499, filed Dec. 7, 1990.

The present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius.

EXAMPLE 1

Calcium sulfate ($CaSO_4$) grade H-45, available from United States Gypsum, Industrial Gypsum Division, Chicago, Ill., is a hygroscopic material which can hold up to two waters of hydration ($CaSO_4.2H_2O$). Wood pulp based papers are formed using H-45 grade $CaSO_4$ according to the following formulations:

| TYPE | % $CaSO_4$ | Basis Wt. ($g/m^2$) | POROSITY (Coresta) |
|---|---|---|---|
| A | 40 | 85 | 10 |
| B | 40 | 40 | 15 |
| C | 10 | 50 | 50 |
| D | 27 | 25 | 25 |

Substrates are formed using either the DeCoufle or modified KDF-2 equipment from the papers prepared from the Type B, C, and D, formulations and evaluated for aerosol delivery and scorch resistance. The Type D substrate, loaded at from 150 to 200% with glycerin, provides the best aerosol delivery at a 300° C. incoming gas temperature, without significant scorching.

EXAMPLE 2

Fuel Element Preparation

A generally cylindrical fuel element 9 mm long and 4.5 mm in diameter, and having an apparent (bulk) density of about 1.02 g/cc is prepared from about 72 parts hardwood pulp carbon having an average particle size of 12 microns in diameter, about 20 parts of blended tobacco dust including Burley, flue cured and oriental, the dust being approximately 200 Tyler mesh, and 8 parts Hercules 7HF SCMC binder.

The hardwood pulp carbon is prepared by carbonizing a non-talc containing grade of Grande Prairie Canadian kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to fine power having an average particle size of about 12 microns in diameter.

The finely powdered hardwood carbon is admixed with the tobacco dust, the sodium carboxymethyl cellulose binder, and sufficient water to provide a mixture having a stiff, dough-like paste form.

Fuel elements are extruded using a ram extruder from the paste so as to have 5 equally spaced peripheral slots or grooves, each having a depth of about 0.032 inch and a width of about 0.016 inch. The configuration of the passageways which extend longitudinally along the length of the fuel element is shown in FIG. 1A. The resulting extrudate is dried in air to provide a resilient extrudate, and the extrudate is cut into 9 mm lengths, thereby providing fuel elements.

Substrate and Sleeve Assembly

A metal capsule is manufactured from aluminum using a metal drawing process. The capsule has a length of about 30 mm, an outer diameter of about 4.6 mm, and an inner diameter of about 4.4 mm. One end of the capsule (the fuel element end) is open; and the other end is closed, except for two slot like openings. The closed end of the capsule is modified to have a single opening of about 4 mm in diameter, thereby converting the capsule into a sleeve.

A substrate rod, 10 mm long and 4.4 mm in diameter, such as that described in Example 1, Type D, is prepared. This substrate segment is inserted into the capsule and pushed to the back end thereof.

A fuel element is then inserted into the front end of the sleeve to a depth of about 2 mm. As such, the fuel element extends about 7 mm beyond the open end of the sleeve, and the substrate is separated from the rear of the fuel element by about 2 to 3 mm.

Insulating Jacket

A 15 mm long, 4.5 mm diameter plastic tube is overwrapped with an insulating jacket material that is also 15 mm in length. In these cigarette embodiments, the insulating jacket is composed of 2 layers of Owens-Corning C-glass mat, each about 1 mm thick prior to being compressed by the jacket forming machine, and after formation, each being about 0.6 mm thick. Sandwiched between the two layers of C-glass is one sheet of reconstituted tobacco paper, about 0.13 mm thick, and a second sheet of 0.13 mm thick reconstituted tobacco paper overwraps the outer layer of glass. The reconstituted tobacco paper sheet, designated P-2674-157 from Kimberly-Clark Corp., is a paper-like sheet containing a blended tobacco extract. The width of the reconstituted tobacco sheets prior to forming are 19 mm for the inner sheet and 26.5 mm for the outer sheet. The final diameter of the jacketed plastic tube is about 7.5 mm.

Tobacco Roll

A tobacco roll consisting of volume expanded blend of Burley, flue cured and oriental tobacco cut filler is wrapped in a paper designated as P-1487-125 from Kimberly-Clark Corp., thereby forming a tobacco roll having a diameter of about 7.5 mm and a length of about 22 mm. See U.S. patent application Ser. No. 07/505,339, filed Apr. 5, 1990, for a preferred volume expanded tobacco process.

Frontend Assembly

The insulating jacket section and the tobacco rod are joined together by a paper overwrap designated as P-2674-190 from Kimberly-Clark Corp., which circumscribes the length of the tobacco/glass jacket section as well as the length of the tobacco roll. The mouth end of the tobacco roll is drilled to create a longitudinal passageway therethrough of about 4.6 mm in diameter. The tip of the drill is shaped to enter and engage the plastic tube in the insulating jacket. The cartridge assembly is inserted from the front end of the combined insulating jacket and tobacco roll, simultaneously as the drill and the engaged plastic tube are withdrawn from the mouth end of the roll. The cartridge assembly is inserted until the lighting end of the fuel element is flush with the front end of the insulating jacket. The overall length of the resulting front end assembly is about 37 mm.

Mouthend Piece

The mouthend piece includes a 20 mm long cylindrical segment of a loosely gathered tobacco paper and a 20 mm long cylindrical segment of a gathered web of non-woven, melt-blown polypropylene, each of which includes an outer paper wrap. Each of the segments are provided by subdividing rods prepared using the apparatus described U.S. Pat. No. 4,807,809 to Pryor et al.

The first segment is about 7.5 mm in diameter, and is provided from a loosely gathered web of tobacco paper available as P-144-GNA from Kimberly-Clark Corp. which is circumscribed by a paper plug wrap available as P-1487-184-2 from Kimberly-Clark Corp.

The second segment is about 7.5 mm in diameter, and is provided from a gathered web of non-woven polypropylene available as PP-100 from Kimberly-Clark Corp. which is circumscribed by a paper plug wrap available as P-1487-184-2 from Kimberly-Clark Corp.

The two segments are axially aligned in an abutting end-to-end relationship, and are combined by circumscribing the length of each of the segments with a paper overwrap available as L-1377-196F from Simpson Paper Company, Vicksburg, Mich. The length of the mouthend piece is about 40 mm.

Final Assembly of Cigarette

The front end assembly is axially aligned in an abutting end-to-end relationship with the mouthend piece, such that the container end of the front end assembly is adjacent to the gathered tobacco paper segment of the mouthend piece. The front end assembly is joined to the mouthend piece by circumscribing the length of the mouthend piece and a 5 mm length of the front end assembly adjacent to the mouthend piece with tipping paper.

EXAMPLE 3

Fuel Element Preparation

A symmetrical fuel element having the configuration substantially of that shown in FIG. 2 is prepared as follows:

A generally cylindrical longitudinally segmented fuel element 12 mm long and 4.8 mm in diameter, and having an apparent (bulk) density of about 1.02 g/cc is prepared from about 89.1 parts hardwood pulp carbon having an average particle size of 12 microns in diameter, 10 parts ammonium alginate (Amoloid HV, Kelco Co.) and 0.9 parts $Na_2CO_3$.

The hardwood pulp carbon is prepared by carbonizing a non-talc containing grade of Grande Prairie Canadian kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35°

C., and then ground to fine podwer having an average particle size of about 12 microns in diameter.

The finely powdered hardwood carbon is dry mixed with the alginate binder, and then a 3% percent aqueous solution of sodium carbonate is added to provide an extrudable mixture, having a final $Na_2CO_3$ content of 0.9 parts by weight.

Cylindrical fuel rods (each about 24 inches long) are extruded using a screw extruder from the mixture having a generally cylindrical shape about 4.8 mm in diameter, with six (6) equally spaced peripheral grooves (about 1 mm×1 mm) with rounded bottoms, running from end to end. The extruded rods have an initial moisture level ranging from about 32–34 weight percent. They are dried at ambient temperature for about 16 hours and the final moisture content is about 7–8 weight percent.

The dried cylindrical rods are end trimmed to a length of 22.5 inches using diamond tipped steel cutting wheels. The rods are placed into a rotating drum having a plurality of channels adapted for accepting and retaining each fuel rod. The rods are secured into the channels on the drum by a plurality of thin rubber straps. The drum is rotated past a shaft having a series of spaced, thin, circular, diamond tipped steel blades. Exemplary blades are the 4-inch diameter 100 to 120 grit blades available from the Norton Co. as 1AIR. The blades are positioned on a shaft so as to create the isolation segments along the length of each rod and trim the rod to the correct length for the next operation. The dimensions of the isolation segments are provided by movement of the shaft or by the use of a wobble plate. The drum continues to rotate and the rod is released therefrom.

The cut rod is then placed into another rotating drum having a plurality of channels adapted for accepting and retaining the rod. The rods are secured in the channels on the drum by a plurality of thin rubber straps. The drum is rotated past a shaft having a series of spaced diamond tipped blades positioned to cut through the rod in the desired locations, forming individual fuel elements. The drum continues to rotate to release the cut fuel elements therefrom into a collection bin.

The finished fuel elements are each 12 mm in length, having end segment lengths of 2.5 mm, two isolation segments 1.5 mm in length each, and an intermediate segment 4.0 mm in length. As such, the cross-sectional area of the isolation segments is about 49% of the cross-sectional area of the end segments. Each fuel element weighs about 165 mg.

Front End Preparation

The fuel element is circumscribed by Owens-Corning C-glass fibers. For details regarding the properties of this material see pages 48–52 of the RJR Monograph, supra. The glass fibers are in turn circumscribed by a paper wrapper available from Kimberly-Clark Corp. as P-2831-189-AA, providing a cylinder having open ends for the passage of air therethrough, a length of about 16 mm and a circumference of about 7.5 mm.

Substrate and Mouthend Piece

A paper tube of about 63 mm length and about 7.5 mm diameter is made from a web of paper about 27 mm wide. The paper is a 76 lb. basis weight paper having a thickness of about 0.012 inch, which is available from Simpson Paper Co. as RJR-001. The paper is formed into a tube by lap-joining the paper using a water-based ethylene vinyl acetate adhesive. To prevent any possible aerosol former migration, the inner surface of the tube is coated with Hercon 70 from Hercules, Inc. about 10 mm into the tube and allowed to dry. Then, the once coated inner surface of the tube is again coated, but with an aqueous solution of calcium chloride (to prevent burning), and allowed to dry.

A 10 mm long substrate segment (about 7.5 mm in diameter) prepared as in Example 1, Type D, is inserted into the coated end of the paper tube such that the front face of the substrate is about 3 mm from the front end of the paper tube. The substrate is held in place securely within the paper tube by friction fit. A 10 mm long segment of tobacco cut filler, wrapped in a circumscribing paper wrapper is inserted into the opposite end of the tube. This tobacco segment is pushed into the tube so that the back end of the tobacco is about 10 mm from the extreme mouth end of the tube.

Into the end of the paper tube opposite the substrate is inserted a cylindrical filter element so as to abut the segment of tobacco cut filler. The filter element has a length of about 10 mm and a circumference of about 24 mm. The filter element is provided using known filter making techniques from triacetin plasticized cellulose acetate tow (8.0 denier per filament; 40,000 total denier), and circumscribing paper plug wrap.

Assembly of the Cigarette

The mouthend piece and front end are positioned in an abutting, end-to-end relationship, such that the front face of the substrate is positioned about 3 mm from the back face of the fuel element. The front end and mouthend pieces are held together by a circumscribing paper wrapper which acts as a tipping paper. The paper wrapper is a low porosity paper available as P-850-61-2 from Kimberly-Clark Corp., and circumscribes the entire length of the front end piece except for about a 3 mm length of the front end piece at the extreme lighting end thereof.

The cigarette is smoked, and yields visible aerosol and tobacco flavor (i.e., volatilized tobacco components) on all puffs for about 10–12 puffs. The fuel element burns to about the region thereof where the burning portion meets the isolation portion, and the cigarette self-extinguishes.

EXAMPLE 4

Fuel Element Preparation

A fuel element 12 mm long and 4.5 mm in diameter, and having an apparent (bulk) density of about 1.02 g/cc is prepared from about 82.85 parts hardwood pulp carbon having an average particle size of 12 microns in diameter, 10 parts ammonium alginate (Amoloid HV, Kelco Co.), 0.9 parts $Na_2CO_3$, 0.75 parts levulinic acid, 5 parts, ball-milled American blend tobacco and 0.5 parts tobacco extract, obtained as described in U.S. patent application Ser. No. 07/710,273, filed Jun. 9, 1991.

The hardwood pulp carbon is prepared by carbonizing a non-talc containing grade of Grande Prairie Canadian kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to fine power having an average particle size of about 12 microns in diameter.

The finely powdered hardwood carbon is dry mixed with the ammonium alginate binder, levulinic acid and the tobaccos, and then a 3% wt. aqueous solution of $Na_2CO_3$ is added to provide an extrudable mixture, having a final sodium carbonate level of about 0.9 parts.

Fuel rods (each about 24 inches long) are extruded using a screw extruder from the mixture having a generally cylindrical shape about 4.5 mm in diameter, with six (6) equally spaced peripheral grooves (about 0.5 mm wide and about 1 mm deep) with rounded bottoms, running from end to end. The extruded rods have an initial moisture level ranging from about 32–34 weight percent. They are dried at ambient temperature for about 16 hours and the final moisture content is about 7–8 weight percent. The dried cylindrical rods are cut to a length of 12 mm using diamond tipped steel cutting wheels.

Insulating Jacket

A 12 mm long, 4.5 mm diameter plastic tube is overwrapped with an insulating jacket material that is also 12 mm in length. In these cigarette embodiments, the insulating jacket is composed of 2 layers of Owens-Corning C-glass mat, each about 1 mm thick prior to being compressed by a jacket forming machine (e.g., such as that described in U.S. Pat. No. 4,807,809), and after formation, each being about 0.6 mm thick. Sandwiched between the two layers of C-glass is one sheet of reconstituted tobacco paper, Kimberly-Clark's P-2831-189-AA. A cigarette paper, designated P-3122-153 from Kimberly-Clark, overwraps the outer layer. The reconstituted tobacco paper sheet, is a paper-like sheet containing a blended tobacco extract. The width of the reconstituted tobacco sheets prior to forming are 19 mm for the inner sheet and 26.5 mm for the outer sheet. The final diameter of the jacketed plastic tube is about 7.5 mm.

Substrate

A substrate rod about 7.5 m in diameter is formed from a highly embossed, 36 gsm, 152 mm wide web of paper containing 25% calcium sulfate available from Kimberly-Clark (K-C) as P3284-19, e.g., on a modified KDF-2 rod forming apparatus. The substrate rod is overwrapped with Simpson paper RJR-002 which is coated on both sides with Hercon 70. The overwrapped rod is cut into 10 mm segments weighing approximately 55 mg.

Tobacco Paper Plug

A tobacco paper rod about 7.5 mm in diameter is formed from a medium embossed, 127 mm wide web of tobacco paper designated as P-144-GNA-CB available from K-C, e.g., using a rod forming apparatus such as that disclosed in U.S. Pat. No. 4,807,809. The rod is overwrapped with a 26.5 mm wide paper P1487-184-2 from K-C and cut into 10 mm lengths.

Front End Overwrap

A front end overwrap paper is formed by laminating several papers including; an outer layer of Ecusta 456 paper, an intermediate layer of 0.0005 continuous cast foil and an inner layer of tissue paper, 12.5 lbs/ream, 20.4 gsm. The laminated layers are held together with a commercial adhesive, Airflex 465, using 1.5 lbs/ream.

Aerosol Tube

A paper aerosol tube about 7.5 mm diameter is made from a web of 112 gsm basis weight Simpson RJR-002 paper, about 27 mm wide, having a thickness of about 0.012 inch. The RJR-002 paper is formed into a tube by lap-joining the paper using a water-based ethylene vinyl acetate adhesive. The inner and outer surface of the paper tube is coated with a Hercon-70. The paper is cut into segments 31 mm in length Mouth End Tube A paper mouth end tube about 7.5 mm diameter is formed from Simpson paper, Type 002-A, lap joined using a hot-melt adhesive No. 448-195K, available from the R. J. Reynolds Tobacco Company. The formed tube is cut into 40 mm length segments.

Filter Plug

A polypropylene filter rod about 7.5 mm in diameter is formed from a PP-100 mat, about 260 mm wide, available from K-C and overwrapped with a 26.5 mm wide web of paper P1487-184-2, available from K-C, e.g., using the apparatus described in U.S. Pat. No. 4,807,809. The overwrapped rod is cut into 20 mm length segments.

Tobacco Roll

A reconstituted tobacco cut filler prepared as described in U.S. patent application Ser. No. 07/710,273 filed Jun. 14, 1991, is formed into a rod about 7.5 mm in diameter and overwrapped with paper, e.g., using the apparatus described in U.S. Pat. No. 4,807,809. The overwrapped tobacco roll is cut into 20 mm lengths.

Assembly of Cigarette

A: Front End Piece Assembly

A 10 mm long substrate piece is inserted into one end of the 31 mm long aerosol tube and spaced about 5 mm from the end, thereby forming a void space of about 5 mm. Approximately 150 mg of a mixture comprising glycerin, tobacco extract and other flavors is applied to the substrate. A 10 mm long tobacco paper plug is inserted into the other end of the aerosol tube until the mouth end of the tobacco paper plug is flush with the mouth end of the aerosol tube.

A 12 mm long insulating jacket piece is aligned with the front end of the aerosol tube so that the insulating jacket piece is adjacent the void space in the aerosol tube. The insulating jacket piece and the aerosol tube are circumscribed with a piece of front end overwrap paper, approximately 26.5 mm×37 mm. The tissue paper side of the overwrap paper is placed toward the aerosol tube and a seam adhesive (2128-69-1) available from the H. B. Fuller Co., Minneapolis, Minn. is used to seal the overlap joint. The 37 mm length of the overwrap is aligned in the longitudinal direction so that the overwrap paper extends from the free end of the aerosol tube to approximately 6 mm over the insulating jacket, leaving approximately 6 mm of the insulating jacket exposed.

The plastic tube in the insulating jacket piece is removed and a 12 mm long fuel element is inserted so that the end of the fuel element is flush with the end of the insulating jacket.

B: Mouthend Piece Assembly

A 20 mm filter plug is inserted into one end of the mouth end tube and a 20 mm tobacco roll inserted into the other end of the mouth end tube so that the plug and roll are flush with the ends of the mouth end tube.

The mouthend piece assembly and the front end piece assembly are aligned so that the tobacco roll abuts the tobacco paper plug and are secured together by a piece of tape to form a cigarette.

The cigarette is smoked, and yields visible aerosol and tobacco flavor (i.e., volatilized tobacco components) on all puffs for about 10–12 puffs. The fuel element burns to about 6 mm back, i.e., to about the region where the foil lined tube overwraps the fuel element, and there the cigarette self-extinguishes.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A substrate for smoking articles comprising an overwrapped rod of gathered cellulose-based paper;

said overwrapped rod having an outer diameter of from about 4 mm to about 8 mm, and wherein;

said cellulose-based paper has a basis weight in the range of about 10 $g/m^2$ to about 90 $g/m^2$; and said cellulose-based paper including up to about 50 weight percent of one or more burn retardant hydrated salts.

2. The substrate of claim 1, wherein the burn retardant hydrated salt comprises a water insoluble salt, added to the paper as a filler, at about 20 to about 40 weight percent.

3. The substrate of claim 1, wherein the burn retardant hydrated salt comprises a water soluble salt, applied to the paper as a coating, at up to about 30 weight percent.

4. The substrate of claim 1, wherein the burn retardant hydrated salt comprises a water soluble salt, applied to the paper as a coating, at about 15 to about 25 weight percent.

5. The substrate of claims 1, 2, or 3, wherein the basis weight of the paper before the addition of any hydrated salt is in the range of about 15 $g/m^2$ to about 60 $g/m^2$.

6. The substrate of claims 1, 2, or 3, wherein the basis weight of the paper before the addition of any hydrated salt is in the range of about 30 $g/m^2$ to about 40 $g/m^2$.

7. The substrate of claims 1, 2, or 3, which, when formed into a rod having the dimensions of about 10 mm long and about 7.5 mm in diameter, provides a pressure drop in the range of about 2 mm $H_2O$ to about 40 mm $H_2O$.

8. The substrate of claims 1, 2, or 3, which, when formed into a rod having the dimensions of about 10 mm long and about 7.5 mm in diameter, provides a pressure drop in the range of about 5 mm $H_2O$ to about 20 mm $H_2O$.

9. The substrate of claims 1, 2, or 3, in which the paper has a density within the range of about 0.20 g/cc to about 3.5 g/cc.

10. The substrate of claims 1, 2, or 3, in which the paper has a density within the range of about 0.35 g/cc to about 2.5 g/cc.

11. The substrate of claims 1, 2, or 3, in which the width per rod area of the cellulosic material used to form the substrate is within the range of about 2 $mm/mm^2$ to about 7 $mm/mm^2$.

12. The substrate of claims 1, 2, or 3, in which the width per rod area of the cellulosic material used to form the substrate is within the range of about 3 $mm/mm^2$ to about 5 $mm/mm^2$.

13. The substrate of claims 1, 2, or 3, in which the linear width of the cellulose-based paper prior to formation of the substrate rod ranges from about 25 mm to about 305 mm.

14. The substrate of claims 1, 2, or 3, wherein the diameter of the substrate is about 4.5 mm and the linear width of the paper web prior to formation of the substrate rod ranges from about 25 mm to about 125 mm.

15. The substrate of claims 1, 2, or 3, wherein the diameter of the substrate is about 4.5 mm and the linear width of the cellulose based paper prior to formation of the substrate rod ranges from about 50 mm to about 90 mm.

16. The substrate of claims 1, 2, or 3, wherein the diameter of the substrate is about 7.5 mm and the linear width of the cellulose-based paper web prior to formation of the substrate rod ranges from about 125 mm to about 305 mm.

17. The substrate of claims 1, 2, or 3, wherein the diameter of the substrate is about 7.5 mm and the linear width of the cellulose-based paper web prior to formation of the substrate rod ranges from about 150 mm to about 200 mm.

18. The substrate of claims 1, 2, or 3, which further comprises an aerosol forming substance at from about 100% to 250% by weight loading.

19. The substrate of claims 1, 2, or 3, which further comprises an aerosol forming substance at from about 150% to 225% by weight loading.

20. The substrate of claims 1, 2, or 3, which further comprises an aerosol forming substance at from about 175% to 200% by weight loading.

21. The substrate of claims 1, 2, or 3, further having a dry unit weight of from about 2 mg/mm to about 12 mg/mm of substrate length, before the addition of aerosol forming materials.

22. The substrate of claims 1, 2, or 3, further having a dry unit weight of from about 4 mg/mm to about 9 mg/mm of substrate length, before the addition of aerosol forming materials.

23. The substrate of claims 1, 2, or 3, wherein the overwrap is a paper which is chemically treated to reduce migration of any aerosol forming materials loaded on the cellulose-based paper.

24. The substrate of claims 1, 2, or 3, wherein the overwrap is a foil-lined paper.

* * * * *